United States Patent [19]

Sierant

[11] 4,101,988

[45] Jul. 25, 1978

[54] BATHS

[76] Inventor: Stanley Leslie Sierant, Marlands, Cross Roads, Keighley, West Yorkshire, BD21 5QE, England

[21] Appl. No.: 695,898

[22] Filed: Jun. 14, 1976

[51] Int. Cl.[2] ..... A61H 9/00; A47K 3/22

[52] U.S. Cl. ..... 4/173 R; 4/178; 4/180; 128/66

[58] Field of Search ..... 4/146, 185 R, 178, 180, 4/150, 173 R, 181, 185 F, 172.15, 172.17, 145; 128/66, 365, 369

[56] References Cited

U.S. PATENT DOCUMENTS

| | | | |
|---|---|---|---|
| 3,111,686 | 11/1963 | Sierant | 4/180 |
| 3,240,208 | 3/1966 | Everston | 4/180 |
| 3,614,792 | 10/1971 | Sierant | 4/181 |
| 3,623,482 | 11/1971 | Schmidt | 4/180 X |
| 3,752,156 | 8/1973 | Wack | 4/178 X |
| 3,870,040 | 3/1975 | Kulisch | 4/180 X |
| 3,964,472 | 6/1976 | Nicollet | 128/66 |
| 4,000,528 | 1/1977 | Posnick | 4/180 |

*Primary Examiner*—Richard E. Aegerter
*Assistant Examiner*—Stuart S. Levy
*Attorney, Agent, or Firm*—John C. Smith, Jr.

[57] ABSTRACT

The invention provides a device for inserting into the bottom of a bath to form an air bath. The device comprises platform, mat, pad or other panel-like device, the device being arrangeable in the bottom of a bath and containing at least two passageways, one for the supply of air and one for the supply of water.

9 Claims, 5 Drawing Figures

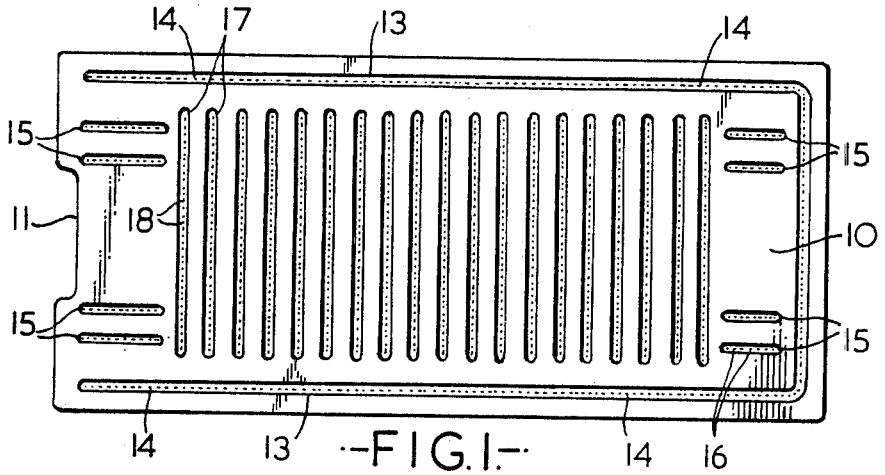
-FIG. 1-
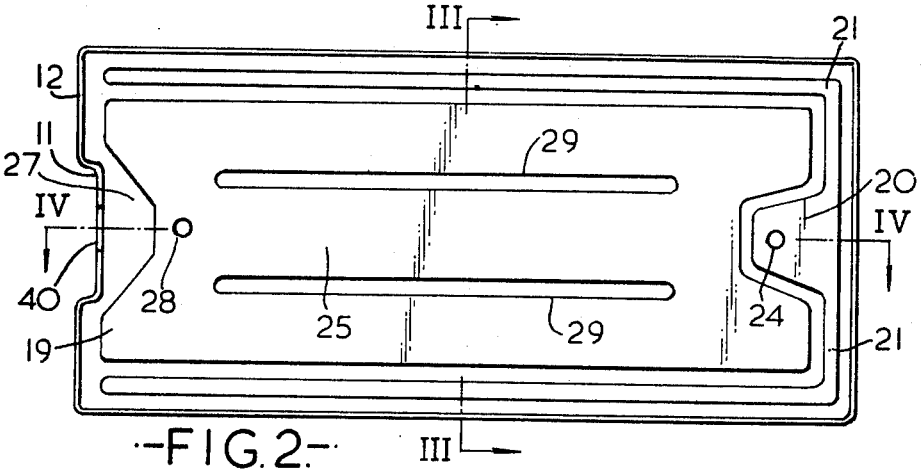
-FIG. 2-
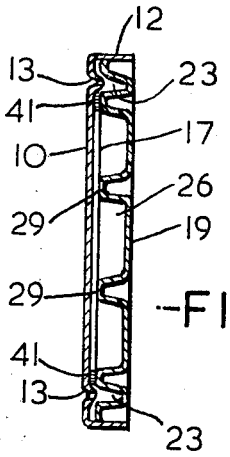
-FIG. 3-

BATHS

The invention relates to baths, and more particularly to baths which are automated in that they have means for aerating the bath water while a person is in the bath with a view to providing a washing action and a beneficial skin and/or body treatment, for humans or animals.

The invention provides a platform, mat, pad or other panel-like device, the device being arrangeable in the bottom of a bath and containing at least two separate passageways, one for the supply of air and the other for the supply of water.

Preferably the passageway for the supply of water extends along at least part of the periphery of the panel-like device, there being a plurality of perforations in the device which permit water to discharge from the passageway.

Preferably the passageway for the supply of air extends over the central area of the panel-like device, there being a plurality of perforations in the device which permit air to discharge from the passageway.

The panel-like device may be generally rectangular, the passageway for the supply of water extending along two sides and one end of the device, in the shape of a U, and the passageway for the supply of air comprising a chamber occupying substantially the whole area lying within the U.

The chamber may be separated by one or more dividing walls into two or more interconnected pockets, channels, ducts or like compartments, the or each dividing wall acting as a reinforcement member which increases the rigidity and strength of the device.

Preferably there is an inlet for water at one end of the device, leading to the passageway for the supply of water, and there is an inlet for air at the opposite end of the device, leading to the passageway for the supply of air. Alternatively however, the two inlets may be at the same end of the panel-like device, or at the same side of the device, or at opposite sides of the device.

The device is preferably formed by securing together face-to-face two sheet-like members, the members being shaped to provide the same passageways when secured together.

There may be a recess or indentation in one edge of the device, so that when the device is positioned in a bath, water may flow out of the bath, passing between the panel and a wall of the bath, through the recess or indentation.

The invention includes a bath having fitted therein a panel-like device as described above. Preferably the bath is provided with a recess in its base to receive the device. The bath may be arranged in combination with a blower for use in blowing air into the passageway for the supply of air in the panel-like device.

By way of example, a specific embodiment of the invention will now be described, with reference to the accompanying drawings, in which:

FIG. 1 is a plan view of one embodiment of panel-like device according to the invention;

FIG. 2 is an underplan of the device shown in FIG. 1;

FIG. 3 is a transverse section through the device, on the line III—III of FIG. 2;

Figure 4:
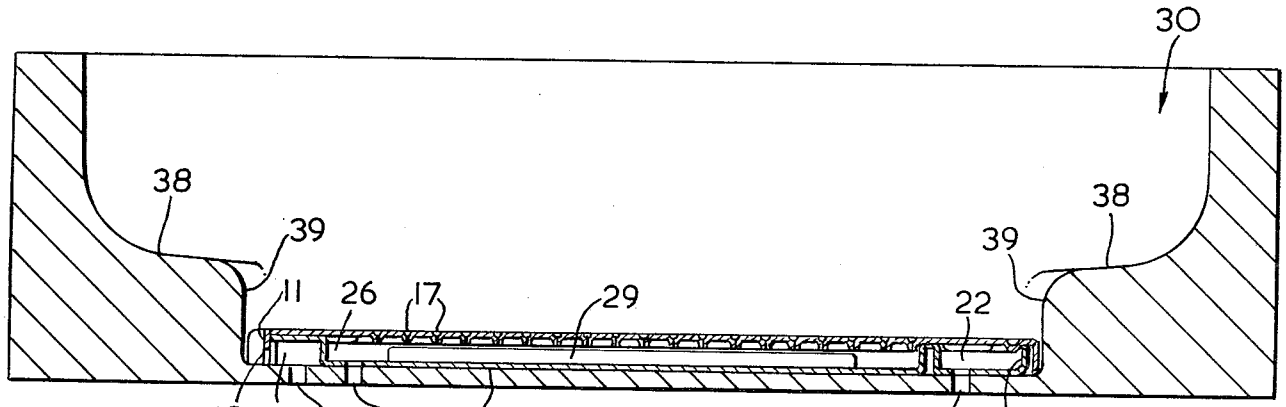
FIG. 4 is a longitudinal section on the line IV—IV of FIG. 2, showing the device in position in a bath.

The panel-like device shown in the Figures comprises two sheet-like members of fibre reinforced resin, secured together face-to-face. The first sheet-like member 10 is substantially planar and rectangular, but there is a small recess 11 at one end and the member has a flange 12 extending around its entire periphery, except for a cut-away portion 40, provided for a purpose described below. On the upper surface of the member 10, extending along each longitudinal peripheral edge and one transverse peripheral edge, there is a groove 13. Spaced apart along the groove is a series of perforations 14. At each end of the member 10 there are two pairs of shorter longitudinally extending grooves 15, one pair at each side of the member, and each groove 15 has a series of perforations 16 therein. Over the central portion of the member 10, there is a plurality of transversely extending grooves 17, each having a series of perforations 18 therein.

The second sheet-like member 19, is of such a size as to fit closely within the flange 12 and abut against the member 10. However the member 19 has two sets of depressions therein, which, with the member 10, define two sets of separate passageways. The first set of depressions comprises a trapezium-shaped depression 20 at one end of the member, from which two channels 21 extend. Each channel extends from the depression 20 along the end of the member 19 and thence along the longitudinal edge of the member 19. When the members 10 and 19 are secured together, there is formed a chamber 22 (FIG. 4) from which two passageways 23 extend. The passageways 23 are in registration with the groove 13 and the perforations 14 communicate with the passageways. The depression 20 has a larger perforation 24 therein, which provides an inlet aperture to the chamber 22.

A further large central depression 25 provides a chamber 26. The depression is generally rectangular, except for a recess at one end to skirt the depression 20, and a further recess 27 at the opposite end to provide room for a waste outlet as described below. The depression 25 registers with the grooves 15 and 17, and the perforations 16 and 18 communicate with the chamber 26. There is an aperture 28 in the depression 25, at the opposite end of the panel-like device from the perforation 24, to provide an inlet to the chamber 26. Two parallel longitudinal portions 29 of the member 19 remain undepressed, thereby providing strengthening ribs for the panel-like device, supporting the central part of the member 10. The members 10 and 19 are secured together by adhesive, and additional resin 41 is applied where indicated in FIG. 3, to ensure that the water passageways 23 cannot communicate with the air chamber 26.

Figure 5:
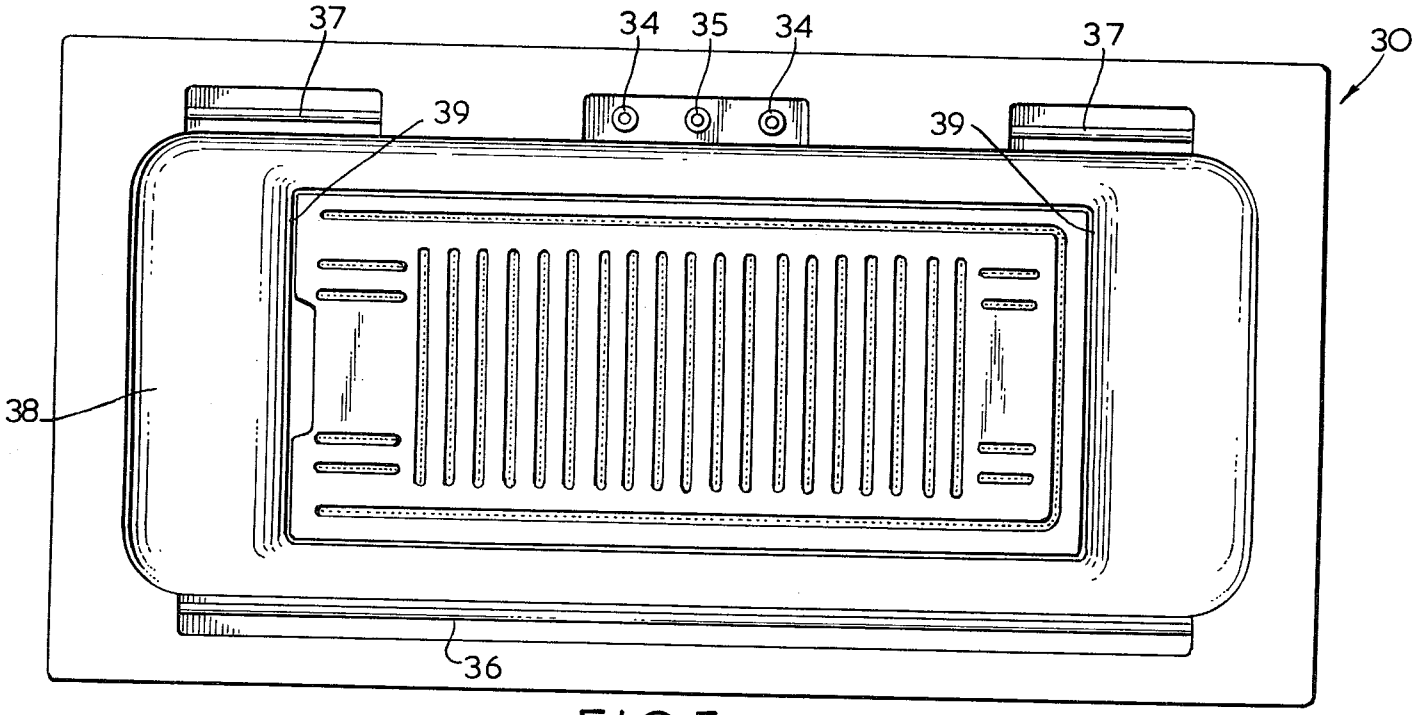
FIG. 5 is a plan view of the device in position in the bath.

In use, the panel-like device is fitted into a rectangular recess in the bottom of a bath 30, as shown in FIGS. 4 and 5. A pipe 31 for the supply of water passes through an aperture in the bottom of the bath and is connected to the perforation 24 in a fluid-tight manner. A pipe 32 for the supply of air is similarly connected to the perforation 28. A fluid-tight seal is provided between each pipe 31 and 32 and the walls of the associated aperture in the base of the bath, by any convenient means.

The waste outlet 33 of the bath, which is of the "pop-up" type, is positioned so that it communicates with the recess 27 formed by the undepressed portion of the member 19. It is thus concealed from view. The water supply pipe 31 is connected via a mixer valve (not shown) to supplies for hot and cold water. The hot and cold water supplies are controlled by two taps 34, arranged at one side of the bath. A central control 35 operates a valve closing the waste outlet 33 of the bath. An electrically or power operated blower (not shown) is connected to the air inlet pipe 32 and this blower is controlled by a switch (not shown) positioned adjacent to the bath. The switch is preferably of the kind operated by a hanging cord, to reduce or eliminate the risk of electric shock.

The bath has one handrail 36 extending along one side, and has two shorter handrails 37 at the opposite side, one on each side of the controls 34 and 35. The bath also has rests 38, for the head or feet, one at each end of the bath. A user of the bath may for example sit or lie directly on the panel-like device, bracing their feet against the vertical wall 39 of one of the foot-rests. A taller user may rest his feet on the horizontal surface of one of the foot-rests, or actually use the foot-rest as a seat.

In use the taps 34 are adjusted as required and water at the desired temperature emerges from the mixing valve and passes through the pipe 31 into the chamber 22. From the chamber 22 it passes along the passages 23 and sprays out of the perforations 14. Liquid soap or bubble-bath mixture is added to the water in the bath and the air blower is switched on. Air is blown into the chamber 26 through the pipe 32 and emerges from the perforations 16 and 18 as a mass of fine air bubbles which have a cleansing and massaging effect on the occupant of the bath. It is unnecessary for the occupant to perform any washing or scrubbing action, as the bath operates as a form of human washing machine.

When it is desired to employ the bath, the air blower is switched off and the control 35 is operated to raise the 'pop-up' waste outlet. Water then flows down through the recess 11, into the recess 27 through the cut-away part 40 of the flange 12, and out of the outlet. The recess 11 and cut-away part 40 not only allow the exit of water, but are also useful during assembly or dismantling of the bath, for allowing a hand to grasp one end of the panel-like device to lower it into the rectangular recess in the bottom of the bath, or lift it out. Furthermore, it is possible for the fingers of a hand to reach the waste outlet when the bath is installed and in use, for example to free any blockage of the outlet.

The panel-like device shown in the Figures provides a particularly efficient and convenient means of providing a bath with means for aerating water within the bath. Only two components are required, which can be easily moulded and secured together. There is no necessity to form special passageways for air and water in the bath itself. It is only necessary to position the panel-like device in the bath and make two connections to the device, one to admit air and one to admit water.

The bath is not "sided" or "handed" in that it can be arranged with the water inlet at the left-hand end of the bath as viewed in FIGS. 4 and 5, and the air inlet at the right-hand end, if so desired. All that is necessary is to turn the panel-like device around, and make the appropriate connections. The waste outlet must be arranged at the air inlet end, so as to register with the recess 27, but the bath 30 has the position of an outlet aperture marked at each end and the plumber or other installer merely cuts out the aperture at the marked position at the desired end.

The invention is not restricted to the details of the foregoing embodiment. For instance it is not essential for the panel-like device to be made of fibre-reinforced resin. It may for example be made of others plastics material (e.g. acrylic), rubber, or any metal which is resistant to corrosion by water.

Although the panel-like device is primarily intended for use with domestic baths, a similar panel-like device may also be used in larger baths or pools, showers, or in baths of any unusual shapes and in machines for washing dishes or clothes, or industrial machines for washing articles. The shape of the device may follow the shape of the container with air being distributed centrally, and water being distributed around the periphery.

The bath may be smaller, e.g. with a single rest 38 at one end, or with a single headrest in the form of a recess to receive the head in the rim of the bath.

The arrangement of controls and handrails may be altered as desired and there may be provision for thermostatic control of the water temperature. There may be more or less handrails or other handholds, arranged in different positions. There may be two recesses in the rim of the bath, at opposite sides of the bath, one containing the controls and one containing a handrail or other handhold. Such an arrangement may be particularly suitable for a smaller bath than that shown. Instead of two taps there may be a single tap or other control, movement of the control in one direction providing progressively hotter water and movement in the opposite direction providing progressively colder water.

The bath may be much larger than that shown and the invention may for example be applicable to baths or swimming pools for race-horses. The device may be moulded in one piece e.g. by injection moulding. Warm or hot air may be supplied e.g. by using an arrangement which compresses the air before it emerges from the perforations in the device.

I claim:

1. A bath comprising a tub portion having a generally rectangular recess therein and a generally rectangular panel fitting snugly within said recess, said panel comprising:

(a) an upper sheet-like member forming an upper face of said panel and having first and second sets of a plurality of exit apertures passing therethrough;

(b) a lower sheet-like member sealed to said upper sheet-like member and forming the lower face of said panel;

(c) a plurality of ribs and recesses on at least one of said sheet-like members, said ribs and recesses cooperating with the other of said sheet-like members to define at least first and second passageways within said panel, said passageways being isolated from each other and said recesses forming said first and second passageways being in registration with said first and second sets of apertures respectively;

(d) a first inlet aperture in said lower sheet-like member and communicating with said first passageway; and (e) a second inlet aperture in said lower sheet-like member and communicating with said second passageway; an air supply conduit extending from said first inlet aperture through the underside of said tub portion of said bath in sealed relationship therewith for directing air into said first passageway, distributing said air within said panel throughout said first passageway and projecting said air from the panel through said first set of exit apertures; and a water supply conduit extending from said second inlet aperture through the underside of said tub portion of said bath in sealed relationship therewith for directing water into said second passageway, distributing water within said panel throughout said second passageway and projecting said water from said panel through said second set of exit apertures.

2. A bath as claimed in claim 1 in which said second passageway extends about at least part of said panel adjacent its periphery.

3. A bath as claimed in claim 2 in which said first passageway extends over the central area of said panel and within said second passageway.

4. A bath as claimed in claim 3 in which said panel is generally rectangular, said second passageway being generally U-shaped and extending along two sides and one end of said panel and said first passageway occupying a substantial part of the area lying within said U-shaped second passageway.

5. A bath as claimed in claim 4 wherein said panel comprises at least one reinforcing member extending through said first passageway between said upper and lower sheet-like members to increase the rigidity and strength of the panel.

6. A bath as claimed in claim 1 in which said first set of exit apertures are from 0.025 to 0.100 inch in diameter.

7. A bath as claimed in claim 1 in which said first and second inlet aperture are located adjacent opposite ends of said panel.

8. A bath as claimed in claim 1 wherein one edge of said panel includes a recess adapted to permit water contained in said bath to flow therefrom between said panel and a wall of said bath and through said recess.

9. A bath as claimed in claim 1 wherein said tub portion includes an internal step portion at at least one end thereof to serve as a foot rest or head rest.

* * * * *